United States Patent [19]

Webb et al.

[11] Patent Number: 4,964,487

[45] Date of Patent: Oct. 23, 1990

[54] DEVICE FOR SUPPORTING A MECHANIC IN A HORIZONTAL POSITION ABOVE AN AUTOMOTIVE VEHICLE ENGINE COMPARTMENT

[76] Inventors: A. LeVan Webb; Margaret Webb, both of Rte. 2, Box 1760, Lakeside, Ariz. 85929

[21] Appl. No.: 462,081

[22] Filed: Jan. 8, 1990

[51] Int. Cl.[5] ..... B25H 5/00

[52] U.S. Cl. ..... 182/82; 182/230

[58] Field of Search ..... 182/82, 230, 116; 280/32.6

[56] References Cited

U.S. PATENT DOCUMENTS

| | | | |
|---|---|---|---|
| 2,701,168 | 2/1955 | Schemers | 182/116 |
| 2,969,123 | 1/1961 | Jamerson | 182/116 |
| 2,970,668 | 2/1961 | Snyder | 182/116 |
| 4,397,374 | 8/1983 | Rumage | 280/32.5 |
| 4,530,419 | 7/1985 | Rumage | 280/32.5 |
| 4,618,029 | 10/1986 | Lowry | 182/116 |
| 4,727,958 | 3/1988 | Botello | 182/116 |
| 4,863,178 | 9/1989 | Friesen | 182/116 |
| 4,867,273 | 9/1989 | Schaevitz | 182/116 |

*Primary Examiner*—Reinaldo P. Machado
*Attorney, Agent, or Firm*—T. M. Gernstein

[57] ABSTRACT

A device supports a mechanic above the engine compartment of an automotive vehicle and is movable in at least the vertical and in the horizontal planes. The device also includes a jackscrew lifting element so a user support can be moved vertically with respect to the rest of the device.

4 Claims, 2 Drawing Sheets

DEVICE FOR SUPPORTING A MECHANIC IN A HORIZONTAL POSITION ABOVE AN AUTOMOTIVE VEHICLE ENGINE COMPARTMENT

TECHNICAL FIELD OF THE INVENTION

The present invention relates to the general art of supports, and to the particular field of devices that support a user.

BACKGROUND OF THE INVENTION

Working on an automobile or pickup truck engine is fatiguing because the mechanic must bend over the engine compartment for long periods of time. This cramped position produces back pains and reduces the efficiency of engine repair work.

While the art includes scooter boards and the like for supporting a mechanic beneath an automobile, such devices are not useful when the mechanic must reach through the top of the engine compartment.

Furthermore, since automobiles have various sizes, the height of the engine compartment may vary from vehicle to vehicle. Thus, a mechanic may be required to find a new comfortable position each time he works on a different vehicle. Still further, there are many times in which the mechanic must be located at various locations with respect to the engine so he can work on different elements in the engine. For example, the mechanic may be required to work on one element located near the front of the engine compartment and then work on another element located near the rear of the engine compartment. The mechanic should be free to move about the engine compartment with relative ease and alacrity in order to efficiently carry out a repair job.

Accordingly, there is a need for a device that supports a mechanic in a stable horizontal position above an automotive vehicle engine compartment and which can be adjusted in at least a vertical plane and a horizontal plane.

OBJECTS OF THE INVENTION

It is a main object of the present invention is to provide a device that supports a mechanic in a stable horizontal position above an automotive vehicle engine compartment.

It is another object of the present invention to provide a device that supports a mechanic in a stable horizontal position above an automotive vehicle engine compartment and which can be adjusted in at least a vertical plane and a horizontal plane.

SUMMARY OF THE INVENTION

These, and other, objects are achieved by a device that is fixedly embedded in a floor and which has pivot connections to permit movement in a horizontal plane above an engine compartment, and which also includes coupling connections that permit adjustments of the height of the device in a vertical plane.

In this manner, the device will support a mechanic in a stable horizontal position above an automobile engine compartment and yet can be adjusted in both the vertical and the horizontal planes whereby the mechanic can quickly move to the location that is above the engine compartment and which is most comfortable and convenient for the particular element and task on which he is working.

BRIEF DESCRIPTION OF THE DRAWING FIGURES

DETAILED DESCRIPTION OF THE PREFERRED EMBODIMENT OF THE INVENTION

Figure 1:
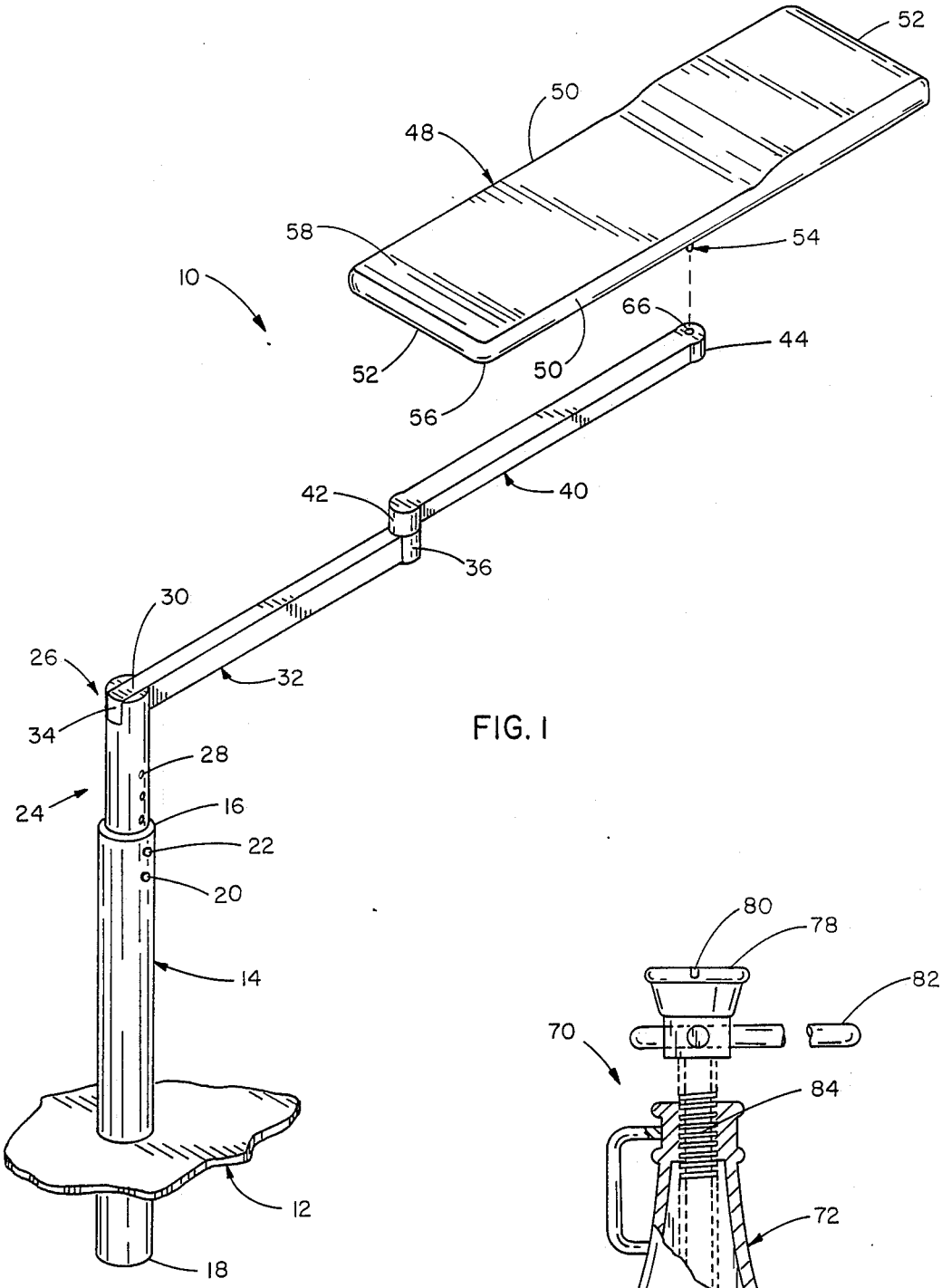
FIG. 1 is a perspective showing the device for supporting a mechanic in a horizontal position above an automotive vehicle engine compartment embodying the present invention.
Figure 4:
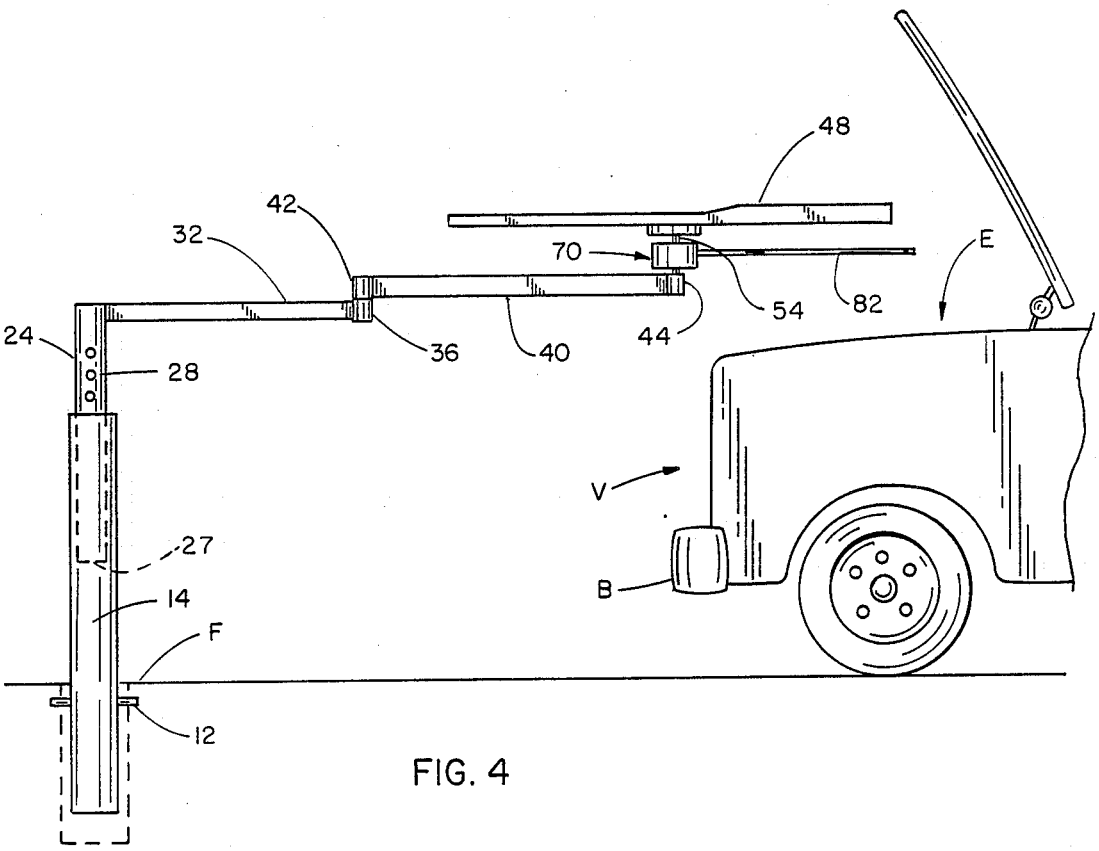
FIG. 4 is a schematic illustrating the device in conjunction with a vehicle.

Shown in FIGS. 1 and 4 is a device 10 for supporting a mechanic in a horizontal position above an automotive vehicle engine compartment while permitting that mechanic to adjust the device in at least a horizontal plane and a vertical plane whereby he is able to quickly and easily reach all areas of an engine and still be comfortably supported.

The device 10 includes a base 12 that is embedded in a concrete floor F adjacent to an automotive vehicle V to provide a stable and secure support for the device. The base 12 preferably is a steel plate or like support and anchoring element.

A first hollow tubular support post 14 is fixedly attached to the support base 12 to extend in a vertical direction upwardly from the floor in which the base is embedded. The support post 14 includes a top end 16 that is located above the floor, and a bottom end 18 that is located beneath the floor whereby the support post 14 is also embedded in the floor for adding further stability to the device. The maximum stability is required since the mechanical lever arms associated with the device in use may be such that great stress is placed on the supporting elements.

The first support post 14 has a length dimension as measured between the top end 16 and the bottom end 18, and has a plurality of fastener-receiving holes, such as hole 20, defined therethrough near the top end 16. The fastener-receiving holes are spaced apart from each other along the length dimension of the support post 14. A fastener, such as a bolt 22, is received through the fastener-receiving holes for a purpose that will be evident from the ensuing discussion.

A second support post 24 is also tubular and is slidably received in the first support post 14 to move in the vertical plane upwardly away from the floor and downwardly toward that floor for adjusting the device in the vertical plane. The second support post 24 includes a top end 26 and a bottom end 27 that is located inside of the first support post and has a length dimension that is measured between the top and bottom ends. A plurality of fastener-receiving holes, such as hole 28, are defined through the second support post 24 and are spaced apart from each other along the length dimension of the second support post.

The holes 28 of the second support post are alignable with the holes 20 of the first support post and the fastener 22 is receivable through such aligned holes to attach the second support post to the first support post at a selected relative positioning whereby the overall height of the support posts as measured between the second support post top end 26 and the floor can be adjusted according to the particular vehicle on which the mechanic is working.

A notch 30 is defined in the second support post from the top end 26 thereof, and a first pivot arm 32 is fixedly attached to the second support post in that notch. The first pivot arm 32 has a proximal end 34 received in the notch 30, and extends horizontally above the floor from the second support post to a distal end 36. A pivot pin (not seen in FIG. 1) is fixedly mounted in the first pivot arm distal end and extends upwardly therefrom in the vertical direction.

A second pivot arm 40 has a proximal end 42 attached to the first pivot arm distal end by the pivot pin, and extends horizontally from that first pivot arm to a distal end 44. The pivotal connection between the first and second pivot arms permits adjustment of the device in the horizontal plane.

A user support 48 is rectangular in peripheral shape and includes sides 50 and ends 52 with a length dimension measured between the ends and a width dimension measured between the sides. The user support is positioned above an engine compartment E of the automotive vehicle. A pivot pin 54 is mounted on a lower surface 56 of the support 48 approximately centrally of that support. The user lies in a prone position on top surface 58 of the support. The pivot pin 54 is received in a pivot hole 60 defined in the distal end 44 of the second pivot arm 40 whereby the position of the support 48 can be adjusted in the horizontal plane with respect to the pivot arms.

Figure 2:
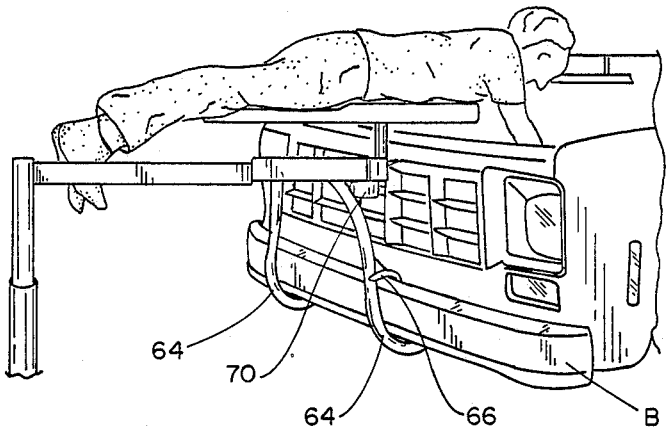
FIG. 2 is a perspective illustrating use of the device of the present invention.

The use of the device 10 is illustrated in FIG. 2, with the user lying on top of the support 48 above the engine compartment E of the vehicle V and in position to reach down into that compartment. The initial vertical position of the device is set, and the user is then able to quickly and easily move the horizontal position of the device by grasping the engine compartment and moving the support. The pivot connections permit such adjustment of the position of the user in the horizontal plane.

The device 10 also includes two S-shaped frame elements 64 that add further support to the device. Each of the frame elements 64 has one end attached to the vehicle, such as on the fender or bumper B thereof, and the other end attached to the second pivot arm 40. Use of this additional support somewhat limits the freedom of movement of the mechanic, but does add stability to the device. A bracket, such as bracket 66, is also included to add further stability to the device.

The preferred form of the device includes a lifting element 70 interposed between the user support 48 and the second pivot arm 40. The pivot pin 54 is inserted into the top of the lifting element, and the bottom of the lifting element has a pin that fits into the pivot hole 60. Operation of the lifting device is by remote control that is held in the user's hand so that the user can be moved up and down as well as in the horizontal plane so that further adjustments can be made.

Figure 3:
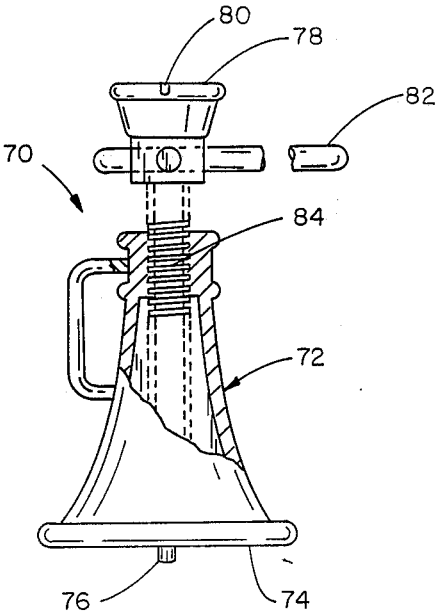
FIG. 3 is a side elevational view of a lifting element used in the device of the present invention.

A preferred form of the lifting element 70 is shown in FIG. 3 to include a jackscrew 72 having a bottom surface 74 with a pin 76 that is received in the pivot hole 60 and a top surface 78 having a pivot hole 80 into which the pivot pin 54 is received. The jackscrew device is connected to a hand-held remote control unit (not shown) by a coupling element 82. The coupling element can also be mechanical and simply be a long lever arm which is twisted in the horizontal plane to operate the jackscrew. The jackscrew includes a lifting screw 84 that moves in the vertical direction toward and away from the second pivot arm distal end 44 to elevate and lower the user support with respect to the pivot arms.

It is understood that while certain forms of the present invention have been illustrated and described herein, it is not to be limited to the specific forms or arrangements of parts described and shown.

We claim:

1. A device for supporting a mechanic in a horizontal position above an automotive vehicle engine compartment comprising:

(A) a base embedded in a floor;

(B) a first hollow tubular support post fixedly attached to said base to extend in a vertical direction upwardly from the floor, said first support post having a top end located above the floor, a bottom end located beneath the floor and a length dimension as measured between said top end and said bottom end, and a fastener receiving hole defined therethrough adjacent to said top end;

(C) a second support post slidably received in said first support post to move in the vertical direction, and including (1) a top end and a bottom end, with said bottom end being received in said first support post;

(2) a length dimension measured between said second support post top end and said second support post bottom end, (3) a plurality of fastener-receiving holes defined through said second support post near said second support post bottom end, said fastener-receiving holes being spaced apart from each other along the second support post length dimension, and (4) a notch defined in said second support post top end;

(D) a first pivot arm having a proximal end fixedly attached to said second support post top end and received in said notch, said first pivot arm extending horizontally above the floor and including a distal end with a pivot pin in said distal end, said pivot pin extending in the vertical direction;

(E) a second pivot arm having a proximal end attached to said pivot pin, said second pivot arm extending horizontally and pivoting in the horizontal plane with respect to said first pivot arm, said second pivot arm having a distal end and a second pivot pin in said second pivot arm distal end;

(F) a lifting element attached to said second pivot pin and having a lifting means which moves in the vertical direction toward and away from said second pivot arm distal end;

(G) a user support attached to said lifting means to move therewith up and down in the vertical direction; and (H) said first support post length dimension and said second support post length dimension being sufficient to elevate said user support above an automotive vehicle engine compartment.

2. The device defined in claim 1 wherein said lifting element includes a jackscrew.

3. The device defined in claim 2 further including two frame elements each attached at one end thereof to said second pivot arm and having means on another end which is attached to an automotive vehicle bumper adjacent to an engine compartment of that automotive vehicle.

4. The device defined in claim 3 wherein said frame elements are S-shaped.

* * * * *